US012358047B2

(12) United States Patent
Liu et al.

(10) Patent No.: US 12,358,047 B2
(45) Date of Patent: Jul. 15, 2025

(54) DATA MINING-BASED METHOD FOR REAL-TIME PRODUCTION QUALITY PREDICTION OF ALUMINUM ALLOY CASTING, ELECTRONIC DEVICE, AND COMPUTER-READABLE STORAGE MEDIUM

(71) Applicant: HANGZHOU CITY UNIVERSITY, Hangzhou (CN)

(72) Inventors: Weipeng Liu, Hangzhou (CN); Tao Peng, Hangzhou (CN); Jun Wu, Hangzhou (CN); Xuxia Zhang, Hangzhou (CN); Anping Wan, Hangzhou (CN); Ting Chen, Hangzhou (CN); Luoke Hu, Hangzhou (CN)

(73) Assignee: HANGZHOU CITY UNIVERSITY, Hangzhou (CN)

( * ) Notice: Subject to any disclaimer, the term of this patent is extended or adjusted under 35 U.S.C. 154(b) by 151 days.

(21) Appl. No.: 18/361,930

(22) Filed: Jul. 31, 2023

(65) Prior Publication Data

US 2025/0001492 A1 Jan. 2, 2025

(30) Foreign Application Priority Data

Jun. 30, 2023 (CN) ..... 202310792988.9

(51) Int. Cl.
*B22D 46/00* (2006.01)
*B22D 21/00* (2006.01)

(52) U.S. Cl.
CPC ..... *B22D 46/00* (2013.01); *B22D 21/007* (2013.01)

(58) Field of Classification Search
CPC ..... B22D 2/00; B22D 2/006; B22D 21/00; B22D 21/007; B22D 46/00
USPC ..... 164/4.1, 150.1, 151, 151.2, 151.4
See application file for complete search history.

(56) References Cited

FOREIGN PATENT DOCUMENTS

CN 100400202 C * 7/2008 ..... B22D 18/08
CN 112906307 A 6/2021

OTHER PUBLICATIONS

Machine translation of CN 100400202 C (Year: 2008).*
Notification to Grant Patent Right for Invention, Chinese Application No. 202310792988.9, mailed Sep. 26, 2024 (3 pages).
CNIPA, Office Action issued for Chinese Application No. 202310792988.9, mailed Aug. 28, 2024 (11 pages).

* cited by examiner

*Primary Examiner* — Kevin P Kerns

(57) ABSTRACT

A data mining-based method for real-time production quality prediction of aluminum alloy casting, includes: (1) based on mold flow analysis results, installing sensors on a casting mold; wherein the sensors include at least one temperature sensor, at least one pressure sensor, at least one contact sensor, and a multi-functional gas sensor; (2) during casting production, real-time collecting temperatures, pressures, and contact times of the aluminum liquid at a plurality of locations of the casting mold, and pressure, composition, humidity, and temperature of gas in a mold cavity, by the installed sensors, for constructing an aluminum alloy casting process parameter set; and (3) inputting the process parameter set to a production quality prediction model; wherein the production quality prediction model is used to judge whether the production quality is qualified, which is obtained by mining a relationship between history casting process parameters and casting quality data.

13 Claims, 2 Drawing Sheets

DATA MINING-BASED METHOD FOR REAL-TIME PRODUCTION QUALITY PREDICTION OF ALUMINUM ALLOY CASTING, ELECTRONIC DEVICE, AND COMPUTER-READABLE STORAGE MEDIUM

CROSS REFERENCE

The present disclosure claims priority of Chinese Patent Application No. 202310792988.9, filed on Jun. 30, 2023, the entire contents of which are hereby incorporated by reference in their entirety.

TECHNICAL FIELD

The present disclosure relates to the technical field of production quality control of aluminum alloy casting process, and in particular to a data mining-based method for real-time production quality prediction of aluminum alloy casting, an electronic device, and a non-transitory computer-readable storage medium.

BACKGROUND

Aluminum alloy casting is an important enabling technology for automotive light-weighting, producing about 80% of automotive aluminum parts. The global demand for aluminum alloy castings will continually increase. The trends of "replacing steel with aluminum and replacing forgings with castings" and "adopting giga- or mega-castings" which is rapidly developing, will make more auto parts be produced through casting technologies. For example, Chinese annual automotive aluminum use will maintain a compound annual growth rate of about 10% over the next ten years. Aluminum alloy castings for fuel vehicles are mainly used as power and transmission system components, such as engine blocks, reducer housing, and wheels. The production technology of these aluminum alloy castings for fuel vehicles is relatively mature, and the quality requirements of the products are not high, such that the existing quality control methods can meet the quality requirements. The global auto industry is turning to the era of new energy vehicles, and the demands for and quality requirements of aluminum alloy castings for new energy vehicles are higher. New energy vehicles use a large number of aluminum alloy castings as chassis and body structure parts of the vehicles, such as subframe, shock tower, and integrated rear floor. These aluminum alloy castings used as structural parts have an important influence on the safety and stability of the vehicles, which significantly increases the quality requirements of the aluminum alloy castings. The shape and production technology of the casting structural parts are relatively complex, which causes the current production qualification rate to be relatively low. There is an urgent need to carry out research on new quality control methods to solve the demands of producing high-quality aluminum alloy castings used as auto structural parts.

Boosted by the manufacturing power strategy with intelligent manufacturing as the main direction, the aluminum alloy casting industry is being upgraded to automation, digitalization, and intelligence. Some top enterprises of aluminum alloy casting have completed the upgrade of automatic production lines and digital control, which provides the necessary basis for the quality control of aluminum alloy casting process based on data mining.

Some scholars have carried out data mining-based production quality prediction and diagnosis methods of aluminum alloy casting process. Some representative studies are: (1) Chinese patent (application No. CN110059738A) proposed an early warning method of die casting quality, which uses slow pressure injection speed, fast pressure injection speed, location of slow speed to fast speed, pressurization establishment time, maximum speed, and maximum pressure as the inputs; (2) Jeongsu Lee et al. proposed methods for process data acquisition of die-casting process and for fault detection based on artificial neural network (Migration from the traditional to the smart factory in the die-casting industry: Novel process data acquisition and fault detection based on artificial neural network. Journal of Materials Processing Technology. 2021), which use die-casting process data as the inputs, including processing time, hydraulic pressure of die-casting machine, pressurization pressure of die-casting machine, and temperature fluctuations; (3) Sangwoo Park et al. proposed a data mining-based approach to establish a relationship between die-casting process parameters and quality indicators to support process parameter optimization and quality diagnosis (Establishment of an IoT-based smart factory and data analysis model for the quality management of SMEs die-casting companies in Korea. International Journal of Distributed Sensor Networks. 2019), which uses die-casting process parameters as inputs, including state parameters of die-casting machine, temperature of melting furnace and holding furnace, cooling water temperature, and ambient temperature. The above studies provided new methods and ideas for production quality control of aluminum alloy casting process.

However, the existing methods for predicting the production quality of aluminum alloy casting process mainly establish a relationship model with quality indicators by mining process parameters of the casting process and parameters within the equipment control system, which are external indirect data. In actual production, there are too many factors affecting the quality of aluminum alloy castings, and the types of process parameters and the parameters within the equipment control systems do not yet fully reflect the quality changes. The current methods using the process and equipment parameters cannot effectively build a prediction model of quality indicators, making it difficult to solve the quality prediction problem of complex aluminum alloy castings used as structural parts. Therefore, there is still an urgent need to develop critical technologies to find and collect key direct factors that can effectively reflect the casting quality, establish the relationship model between factors and quality indicators, and realize the real-time and high-accuracy production quality prediction of aluminum alloy casting process.

SUMMARY OF THE DISCLOSURE

Aiming to address the above problem, the present disclosure provides a data mining-based method for real-time production quality prediction of aluminum alloy casting, which can support online production quality prediction of each aluminum alloy casting, and can effectively reduce the reject rate and reduce the flow of unqualified products to subsequent processes, thereby reducing manufacturing costs.

A data mining-based method for real-time production quality prediction of aluminum alloy casting includes following operations.

(1) Based on mold flow analysis results, installing sensors on a casting mold; the sensors include at least one temperature sensor, at least one pressure sensor, at least one contact sensor, and a multi-functional gas sensor;

(2) During casting production, real-time collecting temperatures of aluminum liquid, pressures of the aluminum liquid, and contact times of the aluminum liquid at a plurality of locations of the casting mold, and pressure, composition, humidity, and temperature of gas in a mold cavity, by the installed sensors, for constructing an aluminum alloy casting process parameter set; and (3) Inputting the aluminum alloy casting process parameter set to a production quality prediction model for aluminum alloy casting process; wherein the production quality prediction model is used to judge whether the production quality is qualified or not; the production quality prediction model is obtained by mining a relationship between history parameters of aluminum alloy casting process and aluminum alloy castings quality data.

In some embodiments, in the step (1), the number of at least one temperature sensor is N, and the N temperature sensors are used to measure the temperatures of the aluminum liquid at different locations in the mold cavity; the number of at least one pressure sensor is M, and the M pressure sensors are used to measure the pressures of the aluminum liquid at different locations in the mold cavity; the number of at least one contact sensor is Q, and the Q contact sensors are used to record times when the aluminum liquid first reaches the (contact sensors; the number of multi-functional gas sensor is one, and the multi-functional gas sensor is used to measure the pressure, the composition, the humidity, and the temperature of the gas inside the mold cavity; N, M, and Q are natural numbers and equal to or greater than one.

In some embodiments, in the step (1), the multi-functional gas sensor is installed at gas discharge outlet of a movable plate or stationary plate; the at least one temperature sensor, the at least one pressure sensor, and the at least one contact sensor are installed on surfaces of a mold core and the mold cavity contacting the aluminum liquid; based on the mold flow analysis results, the at least one temperature sensor is installed at locations with hot nodes, locations prone to air bubble, and locations prone to surface quality problem; the at least one pressure sensor is installed at overflow slots, locations prone to shrinkage, and locations prone to air entrapment; the at least one contact sensor is installed at gates, locations prone to incomplete casting, locations prone to air entrapment, overflow slots, and gas outlets.

In some embodiments, in the step (2), temperature data collected by the N temperature sensors are constructed into a temperature data set $T=(t_1, t_2, \ldots, t_N)$, where $t_n$ represents a temperature value collected by the $n^{th}$ sensor, and $n\in[1, N]$; pressure data collected by the M pressure sensors are constructed into a pressure data set $P=(p_1, p_2, \ldots, p_M)$, where $p_m$ represents a pressure value collected by the $m^{th}$ sensor, and $m\in[1, M]$; contact time data collected by the (contact sensors are constructed into a contact time data set $K=(k_1, k_2, \ldots, k_Q)$, where $k_q$ represents a contact time value of the aluminum liquid collected by the $q^{th}$ sensor, and $q\in[1, Q]$; pressure, composition, humidity, and temperature data collected by the multi-functional gas sensor are constructed into a gas state data set $A=(a_1, a_2, a_3, a_4)$, where $a_1$, $a_2$, $a_3$, $a_4$ represent the pressure value, composition value, humidity value, and temperature value of the gas in the mold cavity, respectively; the aluminum alloy casting process parameter set is constructed as (T, P, K, A).

In some embodiments, the steps for obtaining the production quality prediction model for aluminum alloy casting process are as follows:

based on the at least one temperature sensor, at least one pressure sensor, at least one contact sensor, and multi-functional gas sensor, temperatures of aluminum liquid, pressures of the aluminum liquid, contact times of the aluminum liquid, and pressure, composition, humidity, and temperature of gas are collected during the practical casting production process; the collected data are constructed into an aluminum alloy casting process history parameter set and data preprocessing for the aluminum alloy casting process history parameter set is conducted;

the aluminum alloy casting process history parameter set is labeled with whether the corresponding production quality is qualified or not, and is divided into a training set and a validation set;

the production quality prediction model for aluminum alloy casting process is conducted, trained through samples in the training set, and validated through samples in the validation set.

In some embodiments, the data preprocessing for the aluminum alloy casting process history parameter set includes: supplementation of missing values, removal of abnormal values, and data normalization. The missing values in the aluminum alloy casting process history parameter set are supplemented through the random imputation of similar mean.

In some embodiments, the production quality prediction model for aluminum alloy casting process is based on an extreme gradient boosting algorithm (XGboost).

In some embodiments, the steps for training the production quality prediction model through samples in the training set are as follows:

parameters for training the production quality prediction model are initialized. The parameters include a difficulty coefficient of node cut, a regularization coefficient, a learning rate, and a maximum depth of a tree;

the production quality prediction model is continuously trained through the samples in the training set;

when the training is completed, the prediction error of the production quality prediction model through the samples in the validation set is calculated;

if the prediction error is less than an error threshold, the training ends; if the prediction error is greater than or equal to the error threshold, the training continues and is validated by adjusting the initialization parameters for training the quality prediction model until the prediction error meets requirements.

An electronic device includes a memory and a processor. The memory is coupled to the processor, and the memory is used to store program data and the processor is used to execute the program data to implement the methods as above.

A non-transitory computer-readable storage medium, storing a computer program. The computer program, when executed by a processor, implements the methods as above.

Compared with the related art, the present disclosure has the following beneficial technical effects.

1. the present disclosure installs temperature, pressure, contact, and gas state sensors on the casting mold, and the collected process parameters belong to internal direct factors, which can reflect the casting quality more accurately; the prediction method based on data mining proposed in the present disclosure can effectively decouple a complex relationship between aluminum alloy casting process parameters and product quality, which improves the prediction accuracy of casting quality and is important for revealing the mechanism affecting casting quality.

2. the prediction method of the present disclosure can be arranged into the intelligent control system of the production line to predict the quality of each aluminum alloy casting in real time, which can effectively reduce the reject rate and reduce the flow of unqualified products to the subsequent processes, thereby reducing the manufacturing cost.

DETAILED DESCRIPTION

In order to describe the present disclosure more specifically, the technical solution of the present disclosure is described in detail below in conjunction with the accompanying drawings and specific implementations.

Figure 1:
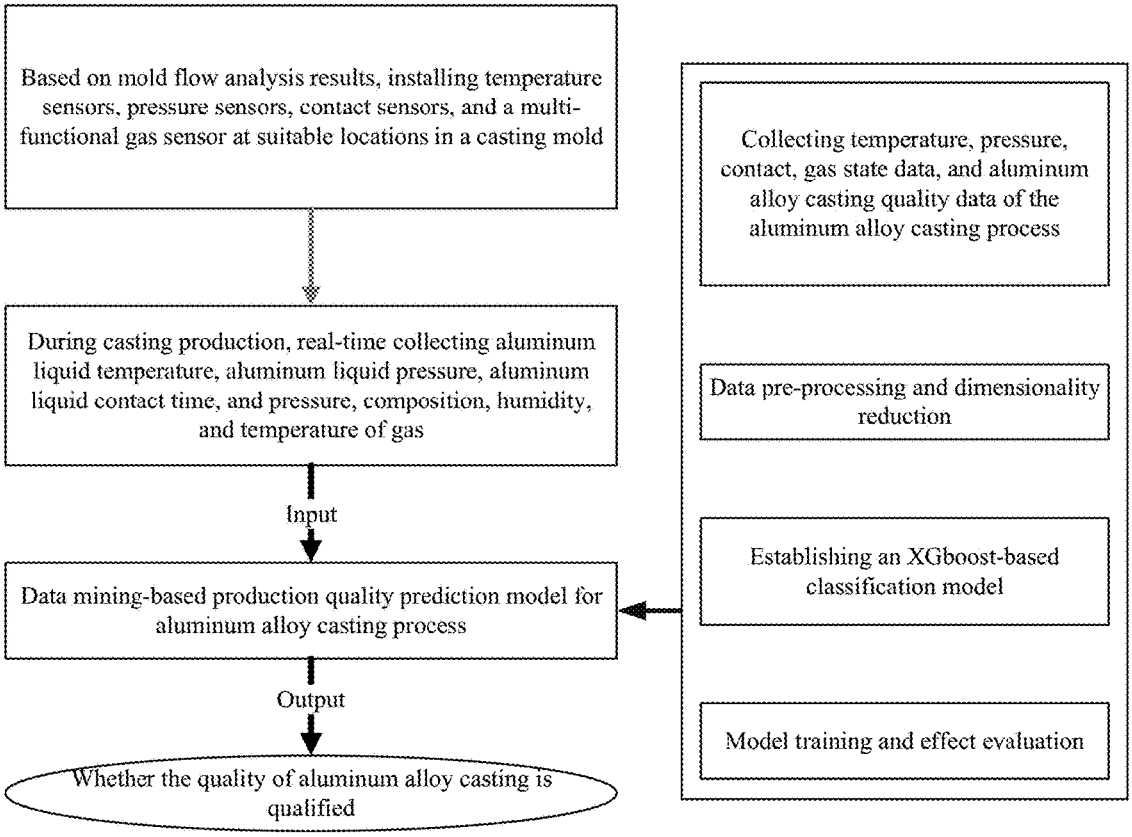
FIG. 1 is a schematic flowchart of a method for real-time production quality prediction of aluminum alloy casting process according to the present disclosure.

As shown in FIG. 1, the present disclosure provides a data mining-based method for real-time production quality prediction of aluminum alloy casting, including the following steps.

(1) Based on mold flow analysis results, N temperature sensors, M pressure sensors, Q contact sensors, and a multi-functional gas sensor are installed at suitable locations in a casting mold; the temperature and pressure sensors are configured to measure temperature and pressure of aluminum liquid in the mold cavity, respectively; the contact sensors are configured to record time when the aluminum liquid first reaches the contact sensors; the multi-functional gas sensor is configured to measure pressure, composition, humidity, and temperature of gas inside the mold cavity. N, M, and Q are natural numbers and equal to or greater than one.

The measurement range of the temperature sensor is 0-750° C., with a precision of 1° C., a response time of less than 20 ms, and a maximum withstand pressure of 200 MPa; a measurement range of the pressure sensor is 0-2000 bar, with a precision of 1 bar, a response time of less than 10 ms, and a maximum withstand temperature of 750° C.; the response time of the contact sensor is less than 3 ms, with a maximum withstand pressure of 200 MPa and a maximum withstand temperature of 750° C.; the response time of the multi-functional gas sensor is less than 1 s, with a measurement ranges of temperature 0-150° C. and a pressure 0-1100 mbar, and collectable composition: oxygen, carbon dioxide, and carbon monoxide.

Figure 2:
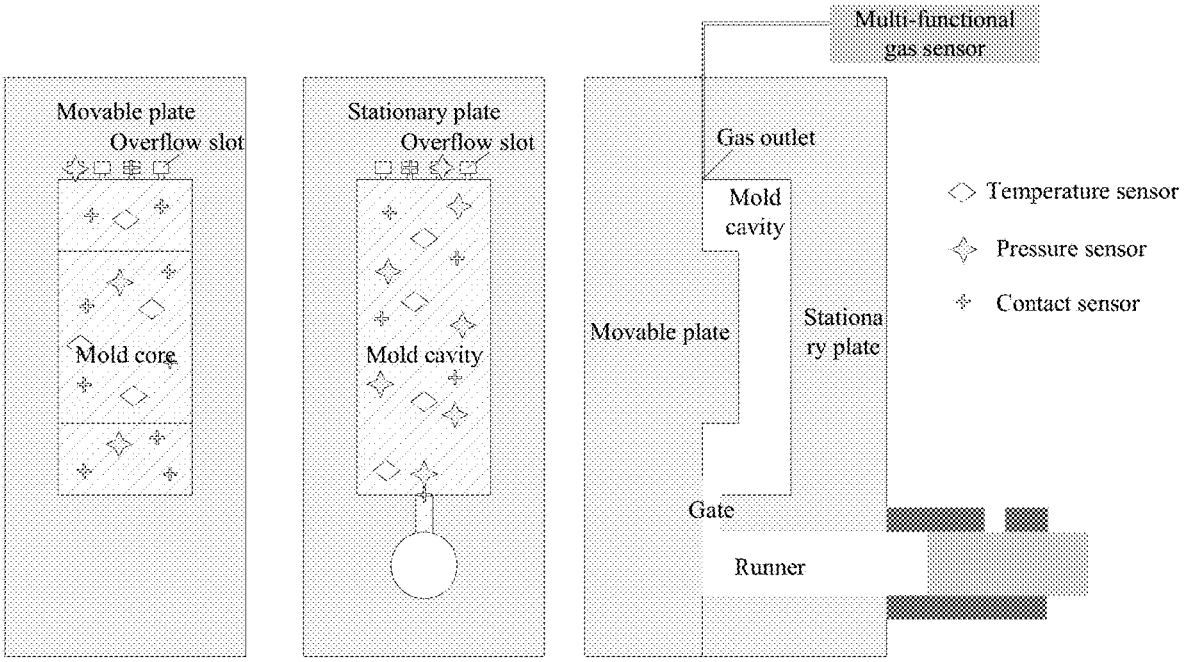
FIG. 2 is a schematic diagram of an installation of sensors in the method according to the present disclosure.

The installation locations of the temperature sensors, pressure sensors, contact sensors, and multi-functional gas sensor are determined as shown in FIG. 2; the multi-functional gas sensor is installed at a gas discharge outlet of the movable plate and stationary plate; the temperature sensors, pressure sensors, and contact sensors are installed on surfaces of the mold core and cavity in contact with aluminum liquid, respectively; based on the mold flow analysis results, the temperature sensors are installed at locations with hot nodes, locations prone to air bubble, and locations prone to surface quality problem; the pressure sensors are installed at overflow slots, locations prone to shrinkage, and locations prone to air entrapment; the contact sensors are installed at gates, locations prone to incomplete casting, locations prone to air entrapment, overflow slots, and gas outlets.

(2) During casting production, aluminum liquid temperatures, aluminum liquid pressures, and aluminum liquid contact times at multiple locations of the mold, and pressure, composition, humidity, and temperature of the cavity gas are collected in real-time by the above sensors; except for the aluminum liquid contact sensor that is passively triggered, the time of data collection by the sensors are given and different.

In the present disclosure, the temperature data collected by the temperature sensors are constructed into a temperature data set $T=(t_1, t_2, \ldots, t_N)$, where $t_n$ represents a temperature value collected by the $n^{th}$ sensor, and $n\in[1, N]$; the pressure data collected by the pressure sensors are constructed into a pressure data set $P=(p_1, p_2, \ldots, p_M)$, where $p_m$ represents a pressure value collected by the $m^{th}$ sensor, and $m\in[1, M]$; the contact time data collected by the contact sensors are constructed into a contact time data set $K=(k_1, k_2, \ldots, k_Q)$, where $k_q$ represents a contact time value of the aluminum liquid collected by the $q^{th}$ sensor, and $q\in[1, Q]$; the pressure, composition, humidity, and temperature data collected by the multi-functional gas sensor are constructed into a gas state data set $A=(a_1, a_2, a_3, a_4)$, where $a_1$, $a_2$, $a_3$, $a_4$ represent the pressure value, composition value, humidity value, and temperature value of the gas in the mold cavity, respectively; the aluminum alloy casting process parameter set is constructed as (T, P, K, A).

(3) The parameter set (T, P, K, A) collected in real time is inputted to a data mining-based production quality prediction model for aluminum alloy casting process Q(T, P, K, A), and the model judges whether the aluminum alloy casting quality is qualified or not in real time.

The construction procedures of the production quality prediction model Q(T, P, K, A) in the present disclosure are as follows.

(3.1) L groups of aluminum alloy casting process history parameter sets are collected, and then an aluminum alloy casting process history parameter matrix $D=((T_1, P_1, K_1, A_1), (T_2, P_2, K_2, A_2), (\ldots), (T_L, P_L, K_L, A_L))^T$ is constructed, where $(T_L, P_L, K_L, A_L)$ represents the $L^{th}$ group process parameter set.

L aluminum alloy castings quality data corresponding to the L groups of aluminum alloy casting process history parameter sets are collected, and then the aluminum alloy casting quality data are constructed into an aluminum alloy casting quality data matrix $F=(F_1, F_2, \ldots, F_L)^T$, where $F_L$ represents the $L^{th}$ aluminum alloy casting quality data and the aluminum alloy casting quality data includes two types: pass and failed, indicated by 1 and 0, respectively.

(3.2) The aluminum alloy casting process history parameter matrix D and the aluminum alloy casting quality data matrix F are pre-processed.

The missing values of the aluminum alloy casting process history parameter matrix D are supplemented through the random imputation of similar mean; the abnormal values exceeding 20% of the mean value of the same type in the aluminum alloy casting process history parameter matrix D and the corresponding values in the aluminum alloy casting process history parameter matrix D and the aluminum alloy casting quality data matrix F are deleted; the non-1 and 0 or missing values in the aluminum alloy casting quality data matrix F and the corresponding values in the aluminum alloy casting process history parameter matrix D are deleted at the same time; after the data deletion, the data size of the aluminum alloy casting process history parameter matrix D and aluminum casting quality data matrix F changes from L to L".

The data of the aluminum alloy casting process history parameter matrix D is normalized using the following formula:

$$X_{norm} = \frac{X - X_{min}}{X_{max} - X_{min}}$$

where $X_{norm}$ is the normalized data, X is the data before normalization, $X_{min}$ is the minimum value of the given data, and $X_{max}$ is the maximum value of the given data.

(3.3) The data mining-based production quality prediction model for aluminum alloy casting process Q(T, P, K, A) is constructed based on the extreme gradient boosting algorithm (XGboost), where the aluminum alloy casting process parameter set (T, P, K, A) is the input of the prediction model, and whether the quality of aluminum alloy casting is qualified or not is the output of the prediction model.

The training objective function of the production quality prediction model is set as the following equations.

$$Obj = -\frac{1}{2}\sum_{j=1}^{T1}\frac{G_j^2}{H_j + \lambda} + \gamma T1$$

$$G_j = \sum\nolimits_{i=I_j} g_i,\ g_i = \frac{\partial L(y_i, y_i'^{(t-1)})}{\partial y_i'^{(t-1)}}$$

$$H_j = \sum\nolimits_{i=I_j} h_i,\ h_i = \frac{\partial^2 L(y_i, y_i'^{(t-1)})}{\partial (y_i'^{(t-1)})^2}$$

$$I_j = \{i | q(x_i) = j\}$$

$$L(y_i, y_i'^{(t-1)}) = \frac{1}{L}\sum\nolimits_{i=1}^{L''}(y_i - y_i'^{(t-1)})^2$$

where Obj is the objective function, T1 is the number of leaf nodes of trees, $\gamma$ is the difficulty coefficient of node cut, $\lambda$ is the regularization coefficient, $y_i$ is the true value of the $i^{th}$ prediction, $y'^{(t-1)}_i$ is the predicted value of the $t-1^{th}$ tree before the $i^{th}$ sample, $I_j$ is the sample set of the $j^{th}$ leaf node, $G_j$ is the sum of the first-order partial derivatives of the sample set contained in the $j^{th}$ leaf node, and $H_j$ is the sum of the second-order partial derivatives of the sample set contained in the $j^{th}$ leaf node.

(3.4) The aluminum alloy casting process history parameter matrix D and the aluminum alloy casting quality data matrix F are divided into a training set and a validation set, where the amount of data in the training set is 0.7*L" and the amount of data in the validation set is 0.3*L"; the initialization parameters for the training of the production quality prediction model for aluminum alloy casting process, including the difficulty coefficient of node cut, regularization coefficient, learning rate, maximum depth of the tree, etc., are set; the established production quality prediction model is trained with the data of the training set; the prediction error c of the trained production quality prediction model with the data of the validation set is calculated using the following equation.

$$c = \frac{1}{0.3 * L''}\sum_{i=1}^{i=0.3*L''}|y_i - y_i'|$$

where $y_i$ is the true value and $y_i'$ is the predicted value.

When the prediction error of the production quality prediction model $c \le c_s$ ($c_s$ is the target error value), the training for the production quality prediction model is completed; when $c \ge c_s$, the initialization parameters for training the production quality prediction model are continuously adjusted until the prediction error meets the requirements.

In the following, a shock tower for automobile produced by aluminum alloy casting is taken as an example to illustrate the specific implementation of the present disclosure.

Step (1): according to the mold flow analysis results for the filling process of the shock tower, six temperature sensors, five pressure sensors, five contact sensors, and one multi-functional gas sensor were installed at key locations on a mold used to produce the shock tower.

Step (2): in an actual production, a group of shock tower production process parameter set is collected, including temperature data [560,550,480,485,469,426]° C., pressure data [120,115,126, 129, 113,90] MPa, contact time [30,40, 55,65,76,93] milliseconds, gas state pressure 52 mbar, oxygen concentration 15.2%, humidity 75%, and temperature value 45° C.

Step (3): the production quality prediction model for shock tower production is constructed and trained as follows.

(3.1) 22,000 shock tower production process history parameter sets and their corresponding shock tower quality data are collected, where qualified indicated by 1 and unqualified indicated by 0.

(3.2) The missing value supplement, abnormal value deletion, and data normalization are performed for the 22,000 collected data. After the data pre-processing, 21.72 thousand data remain.

(3.3) A production quality prediction model for producing the shock tower is established based on the XGboost algorithm, which takes the shock tower production process history parameter set as input and whether the quality of shock tower is qualified as output; the difficulty coefficient of node cut is set to 1, the regularization coefficient is set to 1, the learning rate is set to 0.3, and the maximum depth of the tree is set to 6 in the model training process; 70% of the data set is used for model training, and the remaining 30% of the data set is used to test the prediction error of the model; after several rounds of training, the error of the model drops to 0.15, which is less than the set value of 0.2 and meets the prediction precision requirement.

Step (4): The shock tower production process parameter set collected in step (2) is inputted into the trained model, and the model predicts the product quality to be qualified; a post-inspection finds that indicators of the product meet the requirements and the actual quality is qualified, which is the same as the predicted result of the trained model.

Figure 3:
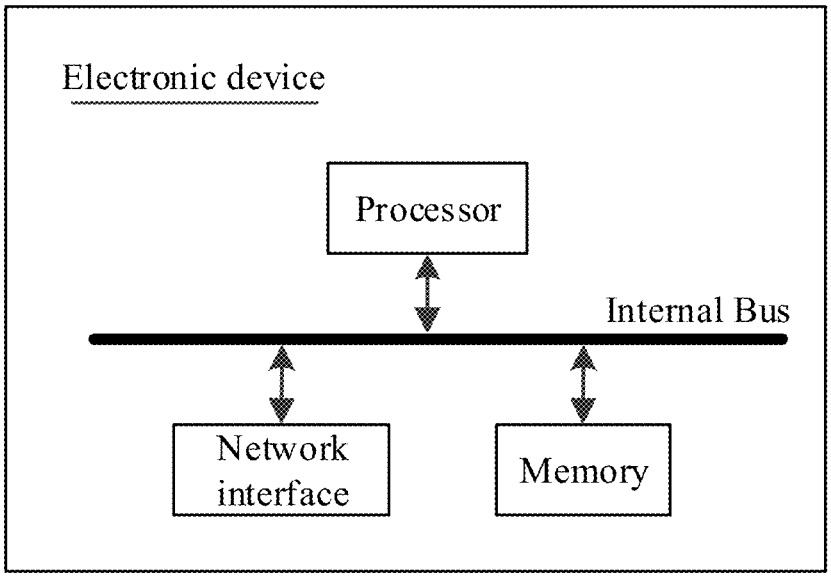
FIG. 3 is a schematic diagram of an electronic device according to the present disclosure.

Accordingly, the present disclosure further provides an electronic device including a memory and a processor; the memory is configured to store one or more programs; when the program is executed by the processor, it enables the processor to implement the above-mentioned method for real-time production quality prediction of aluminum alloy casting process. In addition to the processor, memory, and network interface shown in FIG. 3, the device in the embodiments may include other hardware according to the actual function of the device, which will not be repeated.

Accordingly, the present disclosure further provides a computer-readable storage medium, which stores computer instructions; the computer instructions are executed by the processor to achieve the method for real-time production quality prediction of aluminum alloy casting process. The computer-readable storage medium may be an internal storage unit of the above device, such as a hard disk or memory, or an external storage device, such as a plug-in hard disk, a smart memory card, an SD card, a flash memory card, etc. Further, the computer-readable storage medium may include both internal storage units of the device with data processing capability and external storage devices for storing computer programs, which are used to store other programs and data required by the device, and may be used to store data temporarily that has been output or will be output.

The above description of the embodiments is intended to facilitate the understanding and application of the present disclosure by those skilled in the art, and it is apparent that those skilled in the art can easily make various modifications to the above embodiments and apply the general principles illustrated herein to other embodiments without creative labor. Therefore, the present disclosure is not limited to the above embodiments, and improvements and modifications made to the present disclosure by those skilled in the art in accordance with the present disclosure should be within the scope of the present disclosure.

What is claimed is:

1. A data mining-based method for real-time production quality prediction of an aluminum alloy casting, the method comprising:

(1) based on mold flow analysis results, installing sensors on a casting mold; wherein the sensors include at least one temperature sensor, at least one pressure sensor, at least one contact sensor, and a multi-functional gas sensor;

the number of the at least one temperature sensor is N, and the N temperature sensors are used to measure temperatures of aluminum liquid at different locations in a mold cavity of the casting mold; the number of the at least one pressure sensor is M, and the M pressure sensors are used to measure pressures of the aluminum liquid at different locations in the mold cavity; the number of the at least one contact sensor is Q, and the Q contact sensors are used to record times when the aluminum liquid first reaches the Q contact sensors; the number of the multi-functional gas sensor is one, and the multi-functional gas sensor is used to measure pressure, composition, humidity, and temperature of gas inside the mold cavity; N, M, and Q are natural numbers and equal to or greater than one;

the multi-functional gas sensor is installed at a gas discharge outlet of a movable plate or stationary plate of the casting mold; the at least one temperature sensor, the at least one pressure sensor, and the at least one contact sensor are installed on surfaces of a mold core of the casting mold and the mold cavity contacting the aluminum liquid; based on the mold flow analysis results, the at least one temperature sensor is installed at locations with hot nodes, locations prone to air bubbles, and locations prone to surface quality problems; the at least one pressure sensor is installed at overflow slots, locations prone to shrinkage, and locations prone to air entrapment; the at least one contact sensor is installed at gates, locations prone to incomplete casting, locations prone to air entrapment, overflow slots, and gas outlets;

(2) during casting production, real-time collecting temperatures of the aluminum liquid, pressures of the aluminum liquid, and contact times of the aluminum liquid at a plurality of locations of the casting mold, and pressure, composition, humidity, and temperature of gas in the mold cavity, by the installed sensors, for constructing an aluminum alloy casting process parameter set; and (3) inputting the aluminum alloy casting process parameter set to a production quality prediction model for an aluminum alloy casting process; wherein the production quality prediction model is used to judge whether a production quality of an aluminum alloy casting is qualified or not; the production quality prediction model is obtained by mining a relationship between history parameters of the aluminum alloy casting process and aluminum alloy castings quality data.

2. The method according to claim 1, wherein in the step (2), temperature data collected by the N temperature sensors are constructed into a temperature data set $T=(t_1, t_2, \ldots, t_N)$, where $t_n$ represents a temperature value collected by the $n^{th}$ sensor, and $n\in[1, N]$; pressure data collected by the M pressure sensors are constructed into a pressure data set $P=(p_1, p_2, \ldots, p_M)$, where $p_m$ represents a pressure value collected by the $m^{th}$ sensor, and $m\in[1, M]$; contact time data collected by the Q contact sensors are constructed into a contact time data set $K=(k_1, k_2, \ldots, k_Q)$, where $k_q$ represents a contact time value of the aluminum liquid collected by the $q^{th}$ sensor, and $q\in[1, Q]$; pressure, composition, humidity, and temperature data collected by the multi-functional gas sensor are constructed into a gas state data set $A=(a_1, a_2, a_3, a_4)$, where $a_1$, $a_2$, $a_3$, $a_4$ represent a pressure value, a composition value, a humidity value, and a temperature value of the gas in the mold cavity, respectively; the aluminum alloy casting process parameter set is constructed as (T, P, K, A).

3. The method according to claim 1, wherein the production quality prediction model for the aluminum alloy casting process are trained as follows:

based on the at least one temperature sensor, the at least one pressure sensor, the at least one contact sensor, and the multi-functional gas sensor, collecting temperatures of the aluminum liquid, pressures of the aluminum liquid, contact times of the aluminum liquid, and pressure, composition, humidity, and temperature of gas in the mold cavity during a practical casting production process; constructing the collected data into an aluminum alloy casting process history parameter set and conducting data preprocessing for the aluminum alloy casting process history parameter set;

labeling the aluminum alloy casting process history parameter set with whether the corresponding production quality is qualified or not, to divide the aluminum alloy casting process history parameter set into a training set and a validation set;

conducting the production quality prediction model for the aluminum alloy casting process, training the production quality prediction model through samples in the training set, and validating the production quality prediction model through samples in the validation set.

4. The method according to claim 3, wherein the data preprocessing for the aluminum alloy casting process history parameter set includes: supplementation of missing values, removal of abnormal values, and data normalization; wherein the missing values in the aluminum alloy casting process history parameter set are supplemented through a random imputation of similar means.

5. The method according to claim 3, wherein the steps for training the production quality prediction model through samples in the training set are as follows:

initializing parameters for training the production quality prediction model; wherein the parameters include a difficulty coefficient of node cut, a regularization coefficient, a learning rate, and a maximum depth of a tree;

continuously training the production quality prediction model through the samples in the training set;

when the training is completed, calculating a prediction error of the production quality prediction model through the samples in the validation set;

if the prediction error is less than an error threshold, ending the training; if the prediction error is greater than or equal to the error threshold, continuing the training and validating the production quality prediction model by adjusting the parameters initialized for training the quality prediction model until the prediction error meets requirements.

6. The method according to claim 1, wherein the production quality prediction model for the aluminum alloy casting process is based on an extreme gradient boosting algorithm (XGboost).

7. An electronic device, comprising a memory and a processor; wherein the memory is coupled to the processor, and the memory is used to store program data, and the processor is used to execute the program data to implement the following methods:

(1) based on mold flow analysis results, installing sensors on a casting mold; wherein the sensors include at least one temperature sensor, at least one pressure sensor, at least one contact sensor, and a multi-functional gas sensor;

the number of the at least one temperature sensor is N, and the N temperature sensors are used to measure temperatures of aluminum liquid at different locations in a mold cavity of the casting mold; the number of the at least one pressure sensor is M, and the M pressure sensors are used to measure pressures of the aluminum liquid at different locations in the mold cavity; the number of the at least one contact sensor is Q, and the Q contact sensors are used to record times when the aluminum liquid first reaches the Q contact sensors; the number of the multi-functional gas sensor is one, and the multi-functional gas sensor is used to measure pressure, composition, humidity, and temperature of gas inside the mold cavity; N, M, and Q are natural numbers and equal to or greater than one;

the multi-functional gas sensor is installed at a gas discharge outlet of a movable plate or stationary plate of the casting mold; the at least one temperature sensor, the at least one pressure sensor, and the at least one contact sensor are installed on surfaces of a mold core of the casting mold and the mold cavity contacting the aluminum liquid; based on the mold flow analysis results, the at least one temperature sensor is installed at locations with hot nodes, locations prone to air bubbles, and locations prone to surface quality problems; the at least one pressure sensor is installed at overflow slots, locations prone to shrinkage, and locations prone to air entrapment; the at least one contact sensor is installed at gates, locations prone to incomplete casting, locations prone to air entrapment, overflow slots, and gas outlets;

(2) during casting production, real-time collecting temperatures of the aluminum liquid, pressures of the aluminum liquid, and contact times of the aluminum liquid at a plurality of locations of the casting mold, and pressure, composition, humidity, and temperature of gas in the mold cavity, by the installed sensors, for constructing an aluminum alloy casting process parameter set; and (3) inputting the aluminum alloy casting process parameter set to a production quality prediction model for an aluminum alloy casting process; wherein the production quality prediction model is used to judge whether a production quality of an aluminum alloy casting is qualified or not; the production quality prediction model is obtained by mining a relationship between history parameters of the aluminum alloy casting process and aluminum alloy castings quality data.

8. The electronic device according to claim 7, wherein in the step (2), temperature data collected by the N temperature sensors are constructed into a temperature data set $T=(t_1, t_2, \ldots, t_N)$, where $t_n$ represents a temperature value collected by the $n^{th}$ sensor, and $n \in [1, N]$; pressure data collected by the M pressure sensors are constructed into a pressure data set $P=(p_1, p_2, \ldots, p_M)$, where $p_m$ represents a pressure value collected by the $m^{th}$ sensor, and $m \in [1, M]$; contact time data collected by the Q contact sensors are constructed into a contact time data set $K=(k_1, k_2, \ldots, k_Q)$, where $k_q$ represents a contact time value of the aluminum liquid collected by the $q^{th}$ sensor, and q E [1, Q]; pressure, composition, humidity, and temperature data collected by the multi-functional gas sensor are constructed into a gas state data set $A=(a_1, a_2, a_3, a_4)$, where $a_1$, $a_2$, $a_3$, $a_4$ represent a pressure value, a composition value, a humidity value, and a temperature value of the gas in the mold cavity, respectively; the aluminum alloy casting process parameter set is constructed as (T, P, K, A).

9. The electronic device according to claim 7, wherein the production quality prediction model for the aluminum alloy casting process are trained as follows:

based on the at least one temperature sensor, the at least one pressure sensor, the at least one contact sensor, and the multi-functional gas sensor, collecting temperatures of the aluminum liquid, pressures of the aluminum liquid, contact times of the aluminum liquid, and pressure, composition, humidity, and temperature of gas in the mold cavity during a practical casting production process; constructing the collected data into an aluminum alloy casting process history parameter set and conducting data preprocessing for the aluminum alloy casting process history parameter set;

labeling the aluminum alloy casting process history parameter set with whether the corresponding production quality is qualified or not, to divide the aluminum alloy casting process history parameter set into a training set and a validation set;

conducting the production quality prediction model for the aluminum alloy casting process, training the production quality prediction model through samples in the training set, and validating the production quality prediction model through samples in the validation set.

10. The electronic device according to claim 9, wherein the data preprocessing for the aluminum alloy casting process history parameter set includes: supplementation of missing values, removal of abnormal values, and data normalization; wherein the missing values in the aluminum alloy casting process history parameter set are supplemented through a random imputation of similar means.

11. The electronic device according to claim 9, wherein the steps for training the production quality prediction model through samples in the training set are as follows:

initializing parameters for training the production quality prediction model; wherein the parameters include a difficulty coefficient of node cut, a regularization coefficient, a learning rate, and a maximum depth of a tree;

continuously training the production quality prediction model through the samples in the training set;

when the training is completed, calculating a prediction error of the production quality prediction model through the samples in the validation set;

if the prediction error is less than an error threshold, ending the training; if the prediction error is greater than or equal to the error threshold, continuing the training and validating the production quality prediction model by adjusting the parameters initialized for training the quality prediction model until the prediction error meets requirements.

12. The electronic device according to claim 7, wherein the production quality prediction model for the aluminum alloy casting process is based on an extreme gradient boosting algorithm (XGboost).

13. A non-transitory computer-readable storage medium, storing a computer program; wherein the computer program, when executed by a processor, implements the following methods:

(1) based on mold flow analysis results, installing sensors on a casting mold; wherein the sensors include at least one temperature sensor, at least one pressure sensor, at least one contact sensor, and a multi-functional gas sensor;

the number of the at least one temperature sensor is N, and the N temperature sensors are used to measure temperatures of aluminum liquid at different locations in a mold cavity of the casting mold; the number of the at least one pressure sensor is M, and the M pressure sensors are used to measure pressures of the aluminum liquid at different locations in the mold cavity; the number of the at least one contact sensor is Q, and the Q contact sensors are used to record times when the aluminum liquid first reaches the Q contact sensors; the number of the multi-functional gas sensor is one, and the multi-functional gas sensor is used to measure pressure, composition, humidity, and temperature of gas inside the mold cavity; N, M, and Q are natural numbers and equal to or greater than one;

the multi-functional gas sensor is installed at a gas discharge outlet of a movable plate or stationary plate of the casting mold; the at least one temperature sensor, the at least one pressure sensor, and the at least one contact sensor are installed on surfaces of a mold core of the casting mold and the mold cavity contacting the aluminum liquid; based on the mold flow analysis results, the at least one temperature sensor is installed at locations with hot nodes, locations prone to air bubbles, and locations prone to surface quality problems; the at least one pressure sensor is installed at overflow slots, locations prone to shrinkage, and locations prone to air entrapment; the at least one contact sensor is installed at gates, locations prone to incomplete casting, locations prone to air entrapment, overflow slots, and gas outlets;

(2) during casting production, real-time collecting temperatures of the aluminum liquid, pressures of the aluminum liquid, and contact times of the aluminum liquid at a plurality of locations of the casting mold, and pressure, composition, humidity, and temperature of gas in the mold cavity, by the installed sensors, for constructing an aluminum alloy casting process parameter set; and (3) inputting the aluminum alloy casting process parameter set to a production quality prediction model for an aluminum alloy casting process; wherein the production quality prediction model is used to judge whether a production quality of an aluminum alloy casting is qualified or not; the production quality prediction model is obtained by mining a relationship between history parameters of the aluminum alloy casting process and aluminum alloy castings quality data.

* * * * *